US005887305A

United States Patent [19]

Cellini

[11] Patent Number: 5,887,305

[45] Date of Patent: Mar. 30, 1999

[54] PORTABLE CORKSCREW WITH ACCESSORY TO SHEAR THE CAPS ON THE NECK OF BOTTLES

[76] Inventor: Ferdinando Cellini, Via Percoto 11, 33085 Maniago (PN), Italy

[21] Appl. No.: 929,064

[22] Filed: Sep. 15, 1997

Related U.S. Application Data

[63] Continuation of Ser. No. 662,029, Jun. 12, 1996, abandoned.

[30] Foreign Application Priority Data

Jun. 15, 1995 [IT] Italy ..... UD95A0115

[51] Int. Cl.[6] ..... B25F 1/00

[52] U.S. Cl. ..... 7/155; 30/1.5; 81/3.09; 7/156

[58] Field of Search ..... 7/155, 156, 152, 7/154, 1.5, 173, 320; 30/321, 3.09, 3.36, 3.29; 81/3.07

[56] References Cited

U.S. PATENT DOCUMENTS

| | | | |
|---|---|---|---|
| 2,599,968 | 6/1952 | Acard | 7/155 |
| 2,718,692 | 9/1955 | Krzanowski | 30/1.5 |
| 2,896,317 | 7/1959 | Vaive | 30/1.5 |
| 4,845,844 | 7/1989 | Allen | 30/1.5 |
| 5,363,725 | 11/1994 | Cellini | 81/3.09 |

FOREIGN PATENT DOCUMENTS

| | | | |
|---|---|---|---|
| 0220850 | 5/1987 | European Pat. Off. . | |
| 2519957 | 7/1983 | France . | |
| 839319 | 5/1952 | Germany | 30/1.5 |
| 3927261 | 2/1991 | Germany . | |

*Primary Examiner*—David A. Scherbel
*Assistant Examiner*—Joni B. Danganan
*Attorney, Agent, or Firm*—Antonelli, Terry, Stout & Kraus, LLP

[57] ABSTRACT

Portable corkscrew with accessory to shear the caps on the neck of bottles, the corkscrew comprising a grip (11), on substantially one end of which are pivoted a drawing screw (12) and a supporting lever (13), the shearing accessory (14) being located substantially at the other end **(11*a*) of the grip (11) and comprising a plurality of shearing wheels, the shearing accessory (14) comprising at least two assemblies of wheels, a first assembly of wheels (15) and a second assembly of wheels (17) respectively, these two assemblies of shearing wheels (15, 17) being associated with respective supports, which are reciprocally movable and positionable and which define a first closed inactive position forming substantially a continuity of line together with the outer shape of the grip (11) of the corkscrew (10)** and at least one second opened working position.

9 Claims, 2 Drawing Sheets

PORTABLE CORKSCREW WITH ACCESSORY TO SHEAR THE CAPS ON THE NECK OF BOTTLES

This application is a continuation of application Ser. No. 08/662,029, filed Jun. 12, 1996 now abandoned.

BACKGROUND OF THE INVENTION

This invention concerns a portable corkscrew with an accessory to shear the caps on the neck of bottles.

To be more exact, the invention concerns a corkscrew of a portable type for use with corks or crown corks and incorporating an accessory suitable to shear the cap which normally covers at least the upper part of the neck of bottles for protection against the dirt which may form on the cork, on the neck and on the connecting edge between the cork and the neck.

In the corkscrew according to the invention the accessory to shear the caps is provided directly on the grip of the corkscrew and advantageously at a position substantially opposite to the position of the screw normally employed for drawing the cork from the bottle.

In the state of the art the neck of bottles is normally associated with a cap of tin foil, plastic or another material which covers at least the upper part and top of the neck and which performs aesthetic purposes and the purpose of hygienic protection of the cork.

The cap is normally difficult to remove by hand, and this situation has the result that the cork is often drawn without removing the cap first.

However, the result is that the liquid poured out or being poured or in the form of drops comes into contact with the edges of the torn cap with the resulting hygienic and operational drawbacks.

A plurality of accessories for removing the caps have been disclosed, whether independent or integrated into the structure of the corkscrew, and solve partly this problem by providing a more or less practical, functional and versatile solution.

In the solutions of the state of the art, however, the inclusion of the shearing accessory integrated into the grip of the corkscrew entails a worsening of the engagement and handling characteristics of the corkscrew during its normal use; moreover, the inclusion of this accessory often entails a substantial change of appearance, which spoils the line of the corkscrews and often does not allow a continuous and linear form to be achieved.

Documents of the state of the art, such as EP-A-0220850 for instance, disclose shearing accessories which are independent or integrated into the grip of the corkscrew and which include four shearing wheels grouped in two parallel pairs, and these wheels during the shearing step cooperate with the neck of bottle.

In this type of shearing accessory, which is associated with a corkscrew of a non-portable type, the manual compression action to press the shearing wheels on the neck of the bottle and therefore to carry out the shearing action takes place on a fulcrum which lies on the median axis of the quadrilateral defined by those wheels and outside the ideal area defined by the quadrilateral itself.

This compression action can therefore be considered to be a force which is developed along a cone the vertex of which coincides with that fulcrum.

The result is that the shearing wheels are not brought against the neck of bottle with the same force as each other inasmuch as the wheels lying closer to the fulcrum act on the neck of the bottle with a greater intensity than the other wheels, thus leading to an imperfect different shearing action.

Even when the manual compression action is carried out substantially at the center of the wheels, the shearing action of the wheels on the bottle is seldom properly balanced since the wheels are not constrained in any way in their reciprocal approaching movement.

Another drawback often found with the shearing accessories of the state of the art is that they cannot be adapted to different dimensions of the neck of the bottle and cannot maintain at the same time a shearing action equally effective for all those dimensions.

SUMMARY OF THE INVENTION

The present applicant has designed, tested and embodied this invention to overcome these shortcomings and to provide a practical, economical, functional and versatile solution associated with a corkscrew that can be kept in the pocket.

The purpose of the invention is to provide a corkscrew of a portable type which includes an accessory to shear the cap which is incorporated in the grip and in which the effectiveness and uniformity of the action of all the shearing wheels are ensured.

A further purpose of the invention is to provide a shearing accessory which can be adapted to different dimensions of the neck of the bottle and which maintains for each of those dimensions a substantially constant effectiveness of the shearing.

Yet another purpose of the invention is to provide a corkscrew in which the shearing accessory is fully integrated into the aesthetic line so as to provide a continuity of form and also possesses a conformation suitable to enhance the engagement and handling of the corkscrew in the normal operations of drawing the cork.

Still another purpose of the invention is to embody a corkscrew which, when kept in the pocket, does not damage the material of the pocket and does not create risks of injury for the hand which is inserted to take the corkscrew.

The description of this invention will refer to a portable corkscrew of a type with a drawing screw and a supporting lever, but the invention can be applied also to portable corkscrews with only a drawing screw and the like.

In the corkscrew according to the invention the shearing accessory is fitted to the grip on the side opposite to the position of the drawing screw.

According to the invention the shearing accessory comprises a plurality of shearing wheels, normally three or four, which define at least two separate assemblies of wheels.

Of these two assemblies a first assembly of wheels, which normally comprises two shearing wheels, is fitted immovably to the grip of the corkscrew, while a second assembly of wheels, which may comprise one or two shearing wheels, is fitted to at least one movable support which, although constrained, can be extracted in relation to the grip.

This at least one movable support has a first closed inactive position substantially integrated within the shape of the corkscrew and at least one second opened working position.

The conformation of the various outer surfaces in the closed position is such as will not create risks for the material of the pocket or for the fingers of a hand which intends to handle the corkscrew.

According to a variant both the assemblies of wheels are positioned on supports, which can be moved in relation to the grip, and the assemblies have a first closed inactive position and a second opened working position.

In one embodiment of the invention the movable support can be withdrawn from the grip in a direction substantially perpendicular to the line which connects the axis of rotation of the two wheels included on the stationary support; this axis is normally, but not necessarily, close to or coincides with the longitudinal axis of the corkscrew.

In this way the wheel or wheels on the movable support during their movement of distancing from the wheels on the stationary support always remain parallel to the latter wheels and, where four wheels are included, these wheels in all their reciprocal positions define substantially a quadrilateral with parallel sides consisting of pairs of wheels.

The action of compression exerted on the wheels by the user during the shearing step is always uniform and balanced since, as the movement of the movable support in relation to the stationary support is a single direct movement at a right angle, the wheels are brought towards each other and maintain always a condition of substantial parallelism.

According to a variant the movable support is pivoted on the body of the corkscrew and can be withdrawn therefrom according to an arc of a circle.

According to another variant the movable support is divided into two parts, each part bearing its own shearing wheel and being pivoted on the grip and able to be extracted therefrom.

The different positions which the movable support can take up in relation to the grip and which are defined between a first closed position and a second maximum opened position define the different conditions of use of the shearing accessory with regard to the different dimensions of the neck of the bottle and the required position of the shearing along the neck of the bottle.

The shearing action of the wheels is always constant, irrespective of the initial position of the wheels, this initial position being adjusted by withdrawing the movable support from the grip to a greater or lesser extent.

The movable support advantageously has a rounded outer conformation both for aesthetic reasons of continuity of the line of the corkscrew and, above all, for functional reasons and efficiency of operation since the movable support in the closed position acts also as a means for holding and manipulating the corkscrew so as to facilitate use thereof.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
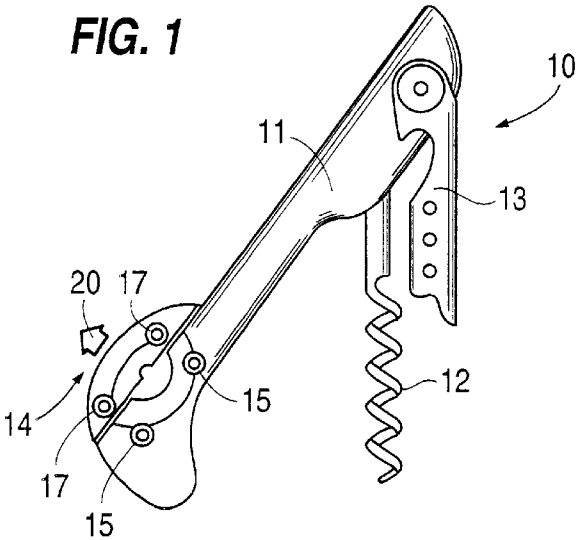
FIG. 1 shows a portable corkscrew of a type including a drawing screw and equipped with an accessory for shearing the caps according to the invention.

A corkscrew 10 shown in FIG. 1 is of a portable type and includes a grip 11, on which are pivoted substantially at or near one of its ends a drawing screw 12 and a supporting lever 13, which makes possible the action of drawing the cork.

An accessory 14 to shear the caps on the neck of bottles is fitted substantially at the opposite end of the grip 11; at that opposite end the grip takes on also the function of a stationary support 16.

Figure 2A:
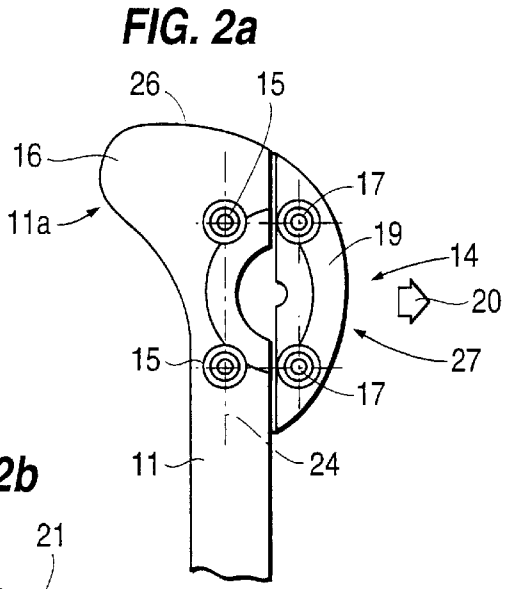
FIG. 2*a* shows a first form of embodiment of the shearing accessory in its closed position.
Figure 2B:
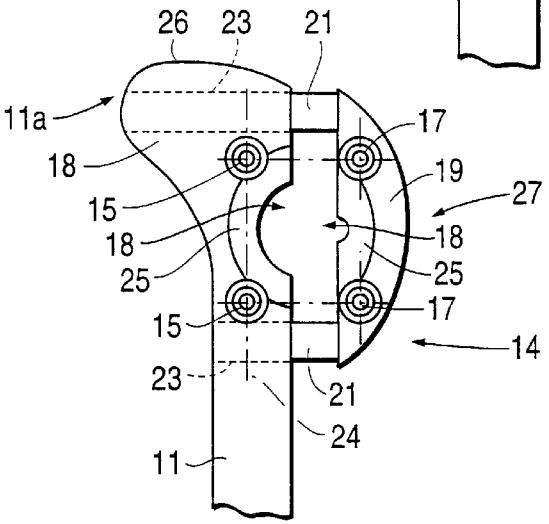
FIG. 2*b* shows the shearing accessory of FIG. 2*a* in its opened position.

In the case of FIGS. 2*a* and 2*b*, the shearing accessory 14 consists of four shearing wheels, of which the first pair 15 is fitted axially along the grip 11 or stationary support 16, whereas the second pair 17 is fitted axially on a movable support 19.

The shearing wheels 15, 17 include a shearing bevel 28 facing downwards (FIG. 6) for the purpose of making the neck of the bottle 30 adhere to the edge of the tin foil, which thus remains adhering to the glass of the bottle.

This movable support 19 can be withdrawn from the stationary support 16 in a direction 20 which is perpendicular to the axis 24 defined, in this case, by the axis of the first pair of shearing wheels 15 lying on the stationary support 16, this axis 24 coinciding substantially in this case with the longitudinal axis of the corkscrew 10.

In particular, the movable support 19 can be displaced from a closed position (FIG. 2*a*) to an open position (FIG. 2*b*) in relation to the stationary support 16.

In this case the movable support 19 comprises a pair of parallel shafts 21, which cooperate with parallel mating holes 23 (shown with lines of dashes in FIG. 2*b*) machined in the stationary support 16.

In this way, the four shearing wheels 15, 17, always define a quadrilateral with parallel sides in any position of the movable support 19 in relation to the stationary support 16.

Moreover, the action of reciprocal approach of the wheels 15, 17 during compression to perform the shearing always takes place according to a direction of parallelism in view of the guiding function which the holes 23 perform in relation to the shafts 21.

At least one the shafts 21 includes at its end stop means cooperating with hollow means or groove means provided in the respective hole 23 so as to prevent complete extraction of the movable support 19.

The shearing accessory 14 is defined not only by the wheels 15, 17, but also by respective facing hollows 25, one of which is provided in the stationary support 16 in cooperation with the stationary shearing wheels 15, while the other hollow is provided in the movable support 19 in cooperation with the movable shearing wheels 17.

Figure 6:
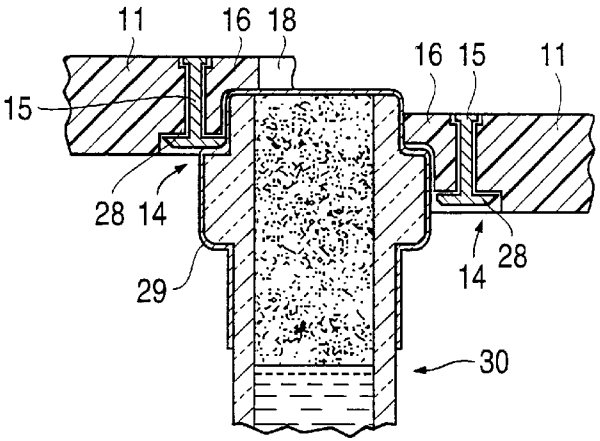
FIG. 6 shows two possible methods of using the corkscrew according to the invention.

These hollows 25 are used for the positioning and support of the top of the neck of the bottle 30 during the step of shearing the cap (see the lefthand part of FIG. 6, which shows partly the corkscrew 10 in association with the bottle 30).

In this case, the hollows 25 are equipped with respective through slots 18, which in this case are formed substantially as an arc of a circle and which, in the position of maximum withdrawal of the movable support 19 and in the case of bottles having a top of a small dimension, enable the base of the hollows 25 to be rested on the collar 29 of the bottle 30 and also enable the shearing of the cap to be carried out substantially at an intermediate position on the collar 29 (see the righthand part of FIG. 6, which too shows the corkscrew 10 only partly).

Figure 3A:
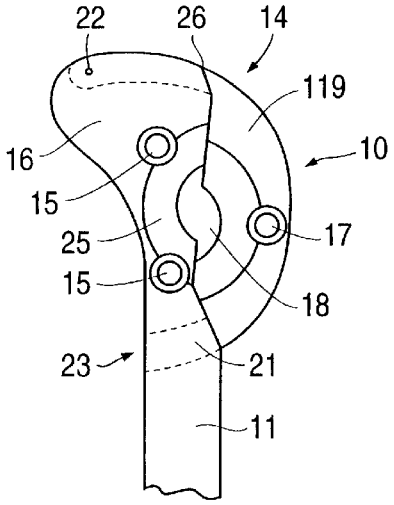
FIGS. 3*a* and 3*b* show a second form of embodiment of the shearing accessory according to the invention in its closed position and opened position respectively.
Figure 3B:
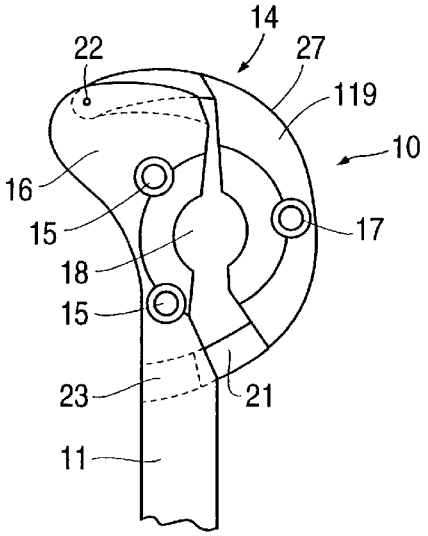

In the examples shown in FIGS. 3*a* and 3*b* the shearing accessory 14 consists of a movable support 119 pivoted at 22 on the stationary support 16 and able to be extracted therefrom 16 by rotation.

The movable support 119 bears a shearing wheel 17 which in the open position is advantageously positioned such that the two stationary shearing wheels 15 are located symmetrically in relation thereto.

The movable support 119 in the closed position (FIG. 3*a*) is integrated into the shape of the stationary support 16 and constitutes continuity of form therewith 16.

The movable support 119 includes a shaft 21 which cooperates with a mating hole 23 during the opening and closing steps.

The shaft 21 may include terminal retaining means to prevent its complete removal from the movable support 119.

Figure 4A:
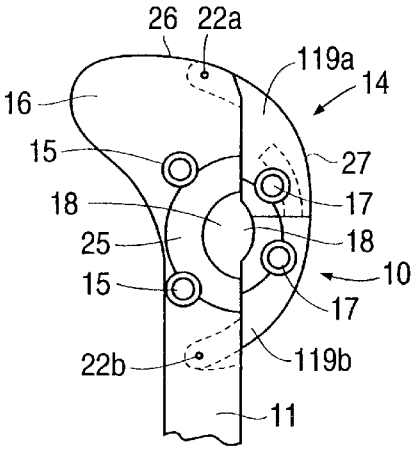
FIGS. 4*a* and 4*b* show a third form of embodiment of the shearing accessory according to the invention in its closed position and opened position respectively.
Figure 4B:
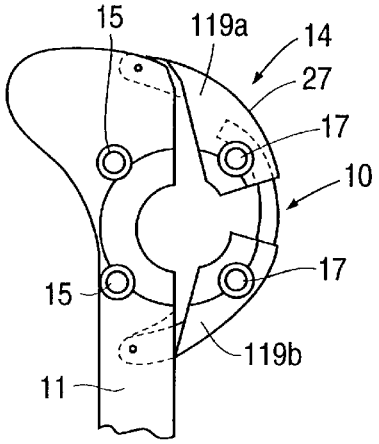

The variants shown in FIGS. 4*a* and 4*b* includes two movable supports 119*a* and 119*b*, each of which bears its own shearing wheel 17 and is pivoted at its own point, respectively 22*a* and 22*b*, on the stationary support 16; these points 22*a* and 22*b* are located on opposite sides of the stationary shearing wheels 15.

In this case too the movable supports 119*a* and 119*b* have a closed position to form continuity of line with the shape of the grip 11 (FIG. 4*a*) and an opened working position (FIG. 4*b*) in which the four shearing wheels 15, 17 are arranged substantially so as to define a quadrilateral.

Figure 5A:
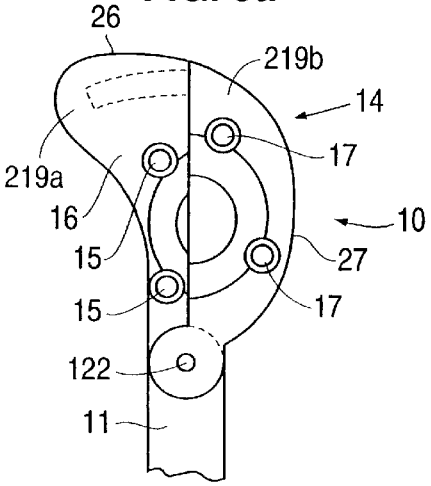
FIGS. 5*a* and 5*b* show a fourth form of embodiment of the shearing accessory according to the invention in its closed position and opened position respectively.
Figure 5B:
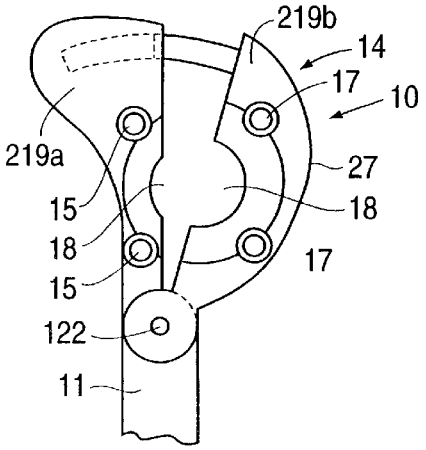

In the further embodiment of FIGS. 5*a* and 5*b* there are included two supports, one of which may be stationary while the other is movable, or both of which may be movable, namely 219*a* and 219*b* respectively, of which one bears the shearing wheels 15, while the other bears the shearing wheels 17.

These two supports 219*a* and 219*b* include a pivot 122 and have a working position (FIG. 5*b*) in which the four wheels 15, 17 form a quadrilateral.

The shearing accessory 14 can be adapted to various sizes of the neck of the bottle by a greater or lesser extraction of the movable supports 19, 119, 219 from the stationary support 16.

The shearing accessory 14 in all its possible positions, however, maintains the constant nature and uniformity of its shearing action.

The movable supports 19, 119, 219 have a rounded and anatomic peripheral conformation 27 so as to act, in the closed position of FIG. 2, as an element to hold and manipulate the corkscrew 10 during its specific employment.

Moreover, this peripheral conformation 27 forms continuity with the rounded profile 26 of the end 11*a* of the grip 11 so as not to spoil the line and forms of the corkscrew 10.

I claim:

1. Portable corkscrew with accessory to shear the caps on the neck of bottles, the corkscrew comprising a grip, on substantially one end of which are pivoted a drawing screw and a supporting lever, the shearing accessory being located substantially at the other end of a grip and comprising a plurality of shearing wheels, the corkscrew being characterized in that the shearing accessory comprises at least two shearing wheel assemblies, a first shearing wheel assembly and a second shearing wheel assembly respectively, at least one of the first and second shearing wheel assemblies comprising a plurality of shearing wheels, these two shearing wheel assemblies being associated with respective supports defining an outer shape of the other end of the grip, the respective supports being reciprocally movable and positionable between a first closed inactive position and at least one second opened working position, wherein the respective supports, in the first closed inactive position, provide the other end of the grip with an anatomic peripheral conformation without any lever protruding therefrom, and wherein the second shearing wheel assembly is fitted on a movable support, of which the first closed inactive position and second opened working position are substantially parallel.

2. Corkscrew as in claim 1, in which the movable support comprises a pair of shafts slidably associated with a pair of parallel holes provided in cooperation with the stationary support on the grip, these holes being substantially perpendicular to the longitudinal axis of the corkscrew.

3. Corkscrew as in claim 2, in which the shearing wheels protrude into their respective hollows with a shearing bevel facing towards the bottom of the bottle.

4. Corkscrew as in claim 1, wherein each of the first and second shearing wheel assemblies comprises two shearing wheels.

5. Corkscrew as in claim 1, wherein opposing edges of the hollows have a concave slot enabling, in the second opened position, the hollows to be rested on a collar on the neck of a bottle during shearing of the cap.

6. Portable corkscrew with accessory to shear the caps on the neck of bottles, the corkscrew comprising a grip, on substantially one end of which are pivoted a drawing screw and a supporting lever, the shearing accessory being located substantially at the other end of a grip and comprising a plurality of shearing wheels, the corkscrew being characterized in that the shearing accessory comprises at least two shearing wheel assemblies, a first shearing wheel assembly and a second shearing wheel assembly respectively, at least one of the first and second shearing wheel assemblies comprising a plurality of shearing wheels, these two shearing wheel assemblies being associated with respective supports defining an outer shape of the other end of the grip, the respective supports being reciprocally movable and positionable between a first closed inactive position and at least one second opened working position, wherein the respective supports, in the first closed inactive position, provide the other end of the grip with an anatomic peripheral conformation without any lever protruding therefrom, and wherein the second shearing wheel assembly comprises a plurality of shearing wheels fitted on respective movable supports, of which the first closed inactive position and second opened working position are arranged along respective arcs of a circle.

7. Corkscrew as in claim 6, wherein each of the first and second shearing wheel assemblies comprises two shearing wheels.

8. Corkscrew as in claim 6, in which the shearing wheels protrude into their respective hollows with a shearing bevel facing towards the bottom of the bottle.

9. Corkscrew as in claim 6, wherein opposing edges of the hollows have a concave slot enabling, in the second opened position, the hollows to be rested on a collar on the neck of a bottle during shearing of the cap.

* * * * *